US010415937B2

(12) United States Patent
Graswald et al.

(10) Patent No.: US 10,415,937 B2
(45) Date of Patent: Sep. 17, 2019

(54) ELECTROMAGNETIC MOBILE ACTIVE SYSTEM

(71) Applicant: TDW Gesellschaft für verteidigungstechnische Wirksysteme mbH, Schrobenhausen (DE)

(72) Inventors: Markus Graswald, Pfaffenhofen an der Ilm (DE); Raphael Gutser, Stadtbergen (DE)

(73) Assignee: TDW Gesellschaft für verteidigungstechnische Wirksysteme mbH, Schrobenhausen (DE)

( * ) Notice: Subject to any disclaimer, the term of this patent is extended or adjusted under 35 U.S.C. 154(b) by 0 days.

(21) Appl. No.: 15/668,399

(22) Filed: Aug. 3, 2017

(65) Prior Publication Data

US 2018/0038675 A1 Feb. 8, 2018

(30) Foreign Application Priority Data

Aug. 4, 2016 (DE) ..... 10 2016 009 408

(51) Int. Cl.
*F41H 13/00* (2006.01)
*F42C 19/08* (2006.01)
(Continued)

(52) U.S. Cl.
CPC ..... *F41H 13/0043* (2013.01); *F41H 13/0093* (2013.01); *F42C 19/0838* (2013.01);
(Continued)

(58) Field of Classification Search
CPC ..... F42B 12/36; F42B 15/00; F42B 30/00; F42B 30/08; F41H 13/0093; F41H 13/0043; F41H 13/00; F42C 19/09; F42C 19/0838
(Continued)

(56) References Cited

U.S. PATENT DOCUMENTS 5,125,104 A * 6/1992 Ohkawa ..... G01S 5/04 102/209
5,192,827 A * 3/1993 Jasper, Jr. ..... F41H 13/0068 102/501
(Continued)

FOREIGN PATENT DOCUMENTS

DE 35 28 338 C1 1/1993
DE 195 28 112 C1 12/1996
(Continued)

OTHER PUBLICATIONS

European Search Report for European Application No. 17001096.1 dated Jan. 5, 2018.
(Continued)

*Primary Examiner* — James S Bergin
(74) *Attorney, Agent, or Firm* — Jenkins, Wilson, Taylor & Hunt, P.A.

(57) ABSTRACT

An electromagnetic mobile active system for fitting in a missile with a detonation-operated magnetic field compressor. The magnetic field compressor has at least one stator coil and at least one armature casing, which is at least partially surrounded by the stator coil and kept at a radial distance. The magnetic field compressor has at least one explosive charge embedded in the armature casing. The magnetic field compressor has at least one power source. For activating the detonation of the explosive charge, a trigger system is provided. The trigger system can be controlled by a pulse of current from the power source, depending on a signal supplied by the missile. A great amount of electrical energy can be generated in the stator coil by the detonation. For the directional radiation of the electrical energy generated by the detonation of the explosive charge, the active system has at least one directional antenna.

20 Claims, 3 Drawing Sheets

(51) Int. Cl.
*F42C 19/09* (2006.01)
*F42B 30/00* (2006.01)
*F42B 15/00* (2006.01)

(52) U.S. Cl.
CPC ..... *F42C 19/09* (2013.01); *F42B 15/00* (2013.01); *F42B 30/00* (2013.01)

(58) Field of Classification Search
USPC ..... 102/209
See application file for complete search history.

(56) References Cited

U.S. PATENT DOCUMENTS

| | | | | |
|---|---|---|---|---|
| 5,251,550 | A * | 10/1993 | Grossler | F42B 12/36 102/293 |
| 5,307,079 | A | 4/1994 | Ross et al. | |
| 6,477,932 | B2 | 11/2002 | Jung | |
| 6,679,179 | B1 | 1/2004 | Bohl et al. | |
| 7,051,636 | B1 * | 5/2006 | Snow | F41H 13/0068 250/341.1 |
| 8,434,412 | B2 * | 5/2013 | Regebro | F41H 13/0093 102/501 |
| 2012/0212363 | A1 | 8/2012 | Brasile et al. | |

FOREIGN PATENT DOCUMENTS

| | | |
|---|---|---|
| DE | 199 16 952 A1 | 7/2003 |
| EP | 1 189 492 A1 | 3/2002 |
| EP | 2 472 215 A1 | 7/2012 |
| EP | 3 038 207 A1 | 6/2016 |
| EP | 3 279 603 B1 | 12/2018 |
| FR | 2 783 316 | 4/2001 |

OTHER PUBLICATIONS

German Office Action for German Application No. 10 2016 009 408.7 dated Jan. 26, 2018.

* cited by examiner

ELECTROMAGNETIC MOBILE ACTIVE SYSTEM

CROSS-REFERENCE TO RELATED APPLICATION

This application claims priority to German Patent Application DE 10 2016 009 408.7, filed Aug. 4, 2016, the entire disclosure of which is incorporated by reference herein.

TECHNICAL FIELD

Various embodiments concern an electromagnetic mobile active system in general for fitting in a missile with a detonation-operated magnetic field compressor.

BACKGROUND

In modern weapons and reconnaissance and communication systems and associated platforms, large-scale integrated electrical and electronic components are increasingly being used. Mention may be made in this respect of the concept of an all-electric ship, which has in addition to energy distribution systems electronic sensors (for example surveillance radar and fire control radar), communication devices and electrical drives and will have future weapons systems such as high-energy lasers and so-called railguns. A current example, the new American destroyers of the Zumwalt class. The same also applies similarly to stationary land-based systems such as radar systems, command and control systems (C2 systems) and anti-aircraft positions. The highly mobile T-14 Armata battle tanks currently being developed in Russia, which in addition to passive and reactive protection can also have modern active protection systems, are a particularly good example.

Active protection systems on a hard-kill basis, such as for example AFGANIT, use radar systems with multiple active phase-lattice antennas installed on the turret that can lock onto and track multiple targets simultaneously. The command and control system allows weapons such as for example multi-EFP active charges and a 12.7 mm machine gun to be incorporated. In addition, there may be further sensor systems for the detection of incoming threats and for weather data and also communication devices. Further electro-optical protection systems, such as for example SHTORA-1 with laser sensors, sensors for detecting the radiation of the control channel of anti-tank missiles and infrared searchlights may also be integrated.

This produces a wide field of applications for electromagnetic active systems. The high packing density of today's electronic systems also increases the sensitivity to electromagnetic attacks significantly in comparison with earlier analog circuits.

Conventional, electrical systems on the basis of high-performance Marx generators for continuous operation allow for example the temporary jamming of electronic components at comparatively short distances of several meters. The main disadvantage of such systems is that the field strengths generated are too small for example to destroy sensors and electronic components with lasting effect. This applies all the more to hardened electronics. They are for example also not suitable for mobile deployment with missiles or UAV (unmanned aerial vehicles), since for example the space requirement for the energy generation is too great.

Explosive-based systems by magnetic field compression do generate an electromagnetic pulse with the aid of explosive charges, but have the disadvantage that practical military use is not possible.

On this basis, an object of the disclosure herein is to provide an active system that improves the disadvantages mentioned.

SUMMARY

This object is achieved by a device and method with features disclosed herein. It should be pointed out that the features of the example embodiments of the devices also apply to embodiments of the method and the arrangement of the device, and vice versa.

An electromagnetic mobile active system for fitting in a missile with a detonation-operated magnetic field compressor is provided. The magnetic field compressor has at least one stator coil. The magnetic field compressor also has at least one armature casing. The armature casing is at least partially surrounded by the stator coil and kept at a radial distance from it. The magnetic field compressor also has at least one explosive charge. The explosive charge is embedded in the armature casing. To be more precise, the explosive charge is at least for the most part surrounded by the armature casing. The magnetic field compressor has at least one power source. For activating the detonation of the explosive charge, a trigger system is also provided. The trigger system can be controlled by a pulse of current from the power source, depending on a distance signal supplied by the missile. A great amount of electrical energy can be generated in the stator coil by the detonation. For the directional radiation of the electrical energy generated by the detonation of the explosive charge, the active system has at least one directional antenna.

The stator coil and the armature casing, as a stator, form an electromagnetic generator or compressor. A magnetic field is built up in the stator coil by a power source.

The disclosure herein is based on the idea that a change in the magnetic field in the stator coil is brought about by the detonation of the explosive charge and a great amount of electrical energy is thereby induced in the coil. This great amount of electrical energy is discharged in a directed manner to a target by way of the directional antenna. The detonation takes place in response to a distance signal, which is provided for the active system by for example a distance sensor of the missile in which the active system is installed. Fitting the active system in a mobile missile and the stand-off effect make meaningful military use possible for the first time.

The dimensions, volume, masses and energy requirement of the device should preferably be set such that the device is suitable for mobile deployment with missiles, UAVs or similar mobile systems on land or under water. Integration in mobile systems is only possible by sufficient miniaturization of all the components of the electromagnetic active system with regard to the overall space, masses and energy requirement.

On the basis of the $1/R^2$ law, an omnidirectional radiation of the electromagnetic waves leads to drastically reduced performances at the target as distances increase. By corresponding antennas, for example and without limitation, systems for focusing by a directional effect can lead to a significant increase in the range of interference or action. This requires for example either the missile/UAV itself and/or the directional antenna to be aligned with the target.

Among the advantages offered by electromagnetic systems are that they can be used in an urban environment, in maritime coastal areas and/or in port facilities in which the use of classical conventional weapons systems may entail great collateral damage to innocent civilians, vehicles and buildings. By contrast, the effect of directed electromagnetic active systems is primarily aimed at electrical and electronic components, and so, depending on the concept used, they can be referred to as non-lethal or less-than-lethal systems.

According to a preferred embodiment of the device, the stator coil has a high ductility. A high ductility allows the mechanical integrity of the stator coil to be maintained for as long as possible during the detonation of the explosive charge and the subsequent expansion.

The radial distance of the armature casing from the stator coil has the advantage of allowing sufficient expansion of the stator coil as a result of the detonative reaction, and so a current can be induced in the coil for as long as possible by the change in the magnetic field. For this purpose, the coil should remain intact for as long as possible (here in the range of microseconds).

According to a preferred embodiment of the device, the stator coil has at least one winding. The stator coil comprises for example copper or some other material that has a high electrical conductivity.

Alternatively, the stator coil and/or the armature casing may comprise copper, gold, aluminum or comparable materials, or an alloy with one or more of the aforementioned materials. This has the advantage that the ductility of the stator coil is very high and the current conduction between the stator coil and the armature casing can be preserved for as long as possible during the detonation.

According to a preferred embodiment, the armature casing has for example depressions, notches or the like, by which a controlled disintegration of the armature casing is possible. According to a preferred embodiment, the armature casing and/or the stator coil may be surrounded by inert, nonmetallic materials such as plastics, such as for example PVC, PTFE or others, and/or composite materials, such as for example CRP, GRP or others. This has the advantage that the range of collateral damage due to fragmentation for example can be controlled, and thereby also reduced.

According to a preferred embodiment, the stator coil has a single-layer or multi-layer winding. The spacing of the windings of the stator coil preferably increases at least partially in the direction of the active system front. With the active system front, the current in the stator coil increases, starting from the location where the detonation is initiated, and so with the direction of the active system front the stator coil preferably has a higher winding density. A heterogeneous structure of the stator coil means for example that a sparkover can be prevented.

According to a preferred embodiment, the power source comprises a Marx generator, capacitor banks, a dielectric generator and/or a ferroelectric generator. The power source is preferably a high-performance, pulsed power source, which provides the initial magnetic flux density for the stator coil.

According to a preferred embodiment, the explosive charge has a detonator. The explosive charge preferably comprises an explosive mixture on the basis of RDX (1,3,5-trinitro-1,3,5-triazacyclohexane), HMX (1,3,5,7-tetranitro-1,3,5,7-tetraazacyclooctane), CL-20 (2,4,6,8,10,12-hexanitro-2,4,6,8,10,12-hexaza-isowurtzitane), TKX-50 (5,50-bistetrazole-1,10-diolate), FOX-7 (1,1-diamino-2,2-dinitroethylene), TATB (triaminotrinitrobenzene), PETN (nitropenta or pentaerythrityl tetranitrate) and/or TNT (trinitrotoluene or 2-methyl-1,3,5-trinitrobenzene) or comparable explosives with preferably a high detonation velocity.

According to a preferred embodiment, the active system has at least one switching device. The switching device is preferably designed to pass on the electrical energy generated by the detonation in the stator coil to the directional antenna.

Furthermore, according to a preferred embodiment, the active system has a cascade circuit and triggering for the specifically intended generation of a target-adapted waveform.

According to a preferred embodiment, the directional antenna serves for increasing the stand-off effect that the power generated by the magnetic field compressor, concentrated by electromagnetic waves, radiates toward a target located at a distance. The electrical power released by the explosive in a short time is preferably discharged in corresponding pulses. Advantageous for this are a corresponding switching device or power electronics that can convert a high pulse of current of a short duration.

According to a preferred embodiment, the distance signal supplied by the missile is activated in dependence on a predetermined distance of the active system from the target. The triggering of the detonation at a predetermined distance from the target allows the electromagnetic effect to be used optimally according to the target to be engaged. Depending on the type of target, it is possible by choosing the distance to achieve the effect ranging from a short-term jamming of the electrical system to almost complete destruction.

According to a preferred embodiment, the distance between the active system and the target at which the active system triggers the detonation of the explosive charge is between 5 and 100 meters. The distance is preferably at least 5 to 100 meters, preferably at least 10 meters and, particularly preferably at least 30 meters. Depending on the target to be engaged, the maximum distance may also exceed 100 meters. This is in each case dependent on the amount of explosive charge used and the type of target to be engaged. With the detonation at a distance of between 5 and 100 meters, for example the sensor systems of modern active protection systems can be destroyed or at least effectively damaged, in order for example to blind a modern weapons system such as a battle tank. This preferably takes place beyond the counterfire range of modern active protection systems. By for example subsequently firing a volley of shots by an anti-tank missile or multi-role missile, modern reactive protection systems and the passive armor protection for example can then be overcome.

According to a preferred embodiment, the active system has at least one deployment device. The deployment device is preferably designed to deliver the electromagnetic pulse generated by the detonation into a target directly or over distances of for example up to 5 meters by conducting contact or spark discharge. For example, the deployment device may have one or more rolled-up electrically conductive wire coils, which are attached by one end to the active system and have at the other end for example an arrow tip. Shortly before the target, the arrow tips are fired at the target and establish an electrical connection with the active system by way of the electrically conductive wire. This has the advantage that escalation tactics can be implemented in times of increasing political and military tensions by varying the effective distance from the target.

According to a preferred embodiment, the explosive charge is arranged in the form of a hollow charge. Alternatively and/or additionally, the explosive charge can generate a blasting effect and/or a fragmenting effect. This has the advantage that the overall performance of the active system can be increased.

According to a preferred embodiment, the active system has an electrically insulated casing. The casing preferably comprises a magnetized and/or magnetizable material. This has the advantage that the magnetic flux in the system, and consequently the overall performance of the active system, can be increased.

An active system arrangement which has at least two active systems as described above is also provided. The effects of the at least two active systems can preferably be instigated simultaneously for a cumulative effect. More preferably, the at least two active systems can be triggered shortly one after the other for a multiple effect.

A cascading, and corresponding triggering, makes it possible for example for the waveform to be adapted to the range that can be sensed by the sensor system. Cumulative effects of multiple electromagnetic active charges for example allow escalation tactics to be implemented in times of increasing political and military tensions. The cascading of multiple generators therefore has the advantage for example both of significantly increasing the potential effective area and of allowing a specific electromagnetic waveform to be set.

A missile having at least one active system as previously described or an active system arrangement as previously described is also provided.

A method for making a generated electromagnetic effect scalable at the target is also provided. The method comprises the step of generating an electromagnetic effect by detonation of at least one explosive charge in an active system as described above. The method also comprises the step of triggering one or more explosive charges at the same time or at a short time one after the other. The detonation is preferably triggered in dependence on a predetermined distance of the active system from the target. The amount of the at least one explosive charge used is preferably preselected in dependence on the target to be hit.

According to a preferred embodiment of the method, a volley of shots is subsequently fired by at least one anti-tank missile and/or multi-role missile. With for example an anti-tank missile or multi-role missile, modern reactive protection systems and the passive armor protection for example can then be overcome.

BRIEF DESCRIPTION OF THE DRAWINGS

In the drawings, generally the same reference signs refer to the same parts throughout the various views. The drawings are not necessarily to scale; instead, generally importance is attached to illustrating the principles of the disclosure herein. In the following description, various embodiments of the disclosure herein are described with reference to the following drawings, in which.

DETAILED DESCRIPTION

The following detailed description makes reference to the accompanying drawings, which show specific details for explanation and embodiments in which the disclosure herein can be put into practice.

The word "exemplary" is used herein with the meaning "serving as an example, case or illustration". Any embodiment or configuration described herein as "exemplary" should not necessarily be interpreted as preferred or advantageous vis-à-vis other embodiments or configurations.

In the following detailed description, reference is made to the accompanying drawings, which form part of this description and show for illustration purposes specific embodiments in which the disclosure herein can be implemented. It goes without saying that other embodiments can be used and structural or logical changes can be made without departing from the scope of protection of the present disclosure. It goes without saying that the features of the various exemplary embodiments described herein can be combined with one another, unless specifically indicated otherwise. Therefore, the following detailed description should not be interpreted in a restrictive sense, and the scope of protection of the present disclosure is defined by the appended claims.

In the context of this description, the terms "connected", and "coupled" are used to describe both a direct and an indirect connection and a direct or indirect coupling. In the figures, identical or similar elements are provided with identical reference signs, insofar as this is expedient.

In the methods described here, the steps can be performed in virtually any desired order without departing from the principles of the disclosure herein, unless a temporal or functional sequence is expressly set out. If it is set out in a patent claim that first one step is performed and then a number of other steps are performed one after the other, this should be understood as meaning that the first step is carried out before all other steps, but the other steps can be carried out in any desired suitable order, unless a sequence is given within the other steps. Parts of claims in which for example "step A, step B, step C, step D and step E" are presented should be understood as meaning that step A is performed first, step E is performed last and steps B, C and D can be performed in any desired order between steps A and E, and that the sequence falls within the formulated scope of protection of the claimed method. Furthermore, specified steps can be performed simultaneously, unless express wording in the claim specifies that they are to be performed separately. By way of example, a step for performing X in the claim and a step for performing Y in the claim can be carried out simultaneously within a single procedure, and the resultant process falls within the worded scope of protection of the claimed method.

Figure 1:
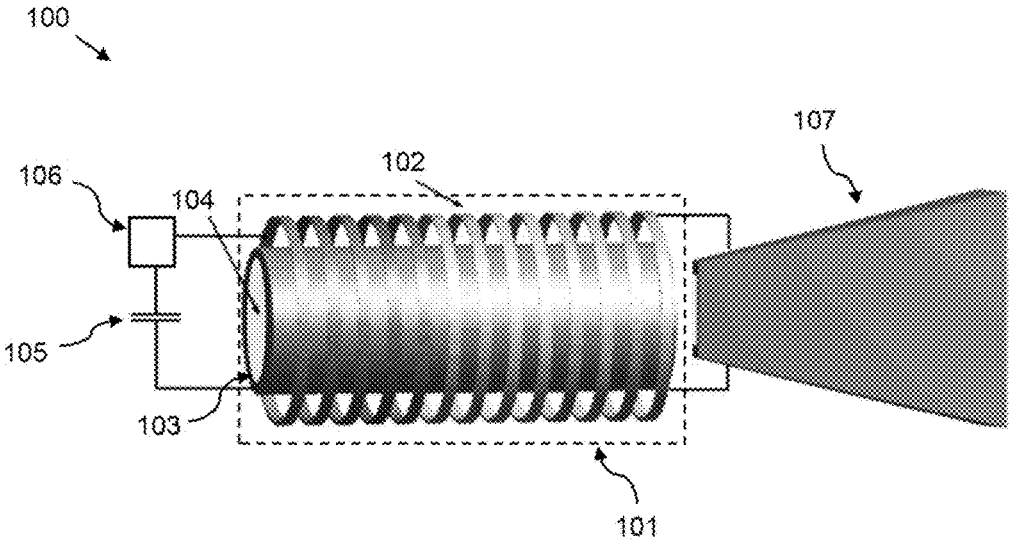
FIG. 1 shows a first embodiment of the electromagnetic active system.

In FIG. 1, a first embodiment of the electromagnetic active system 100 is shown. The active system 100 has a detonation-operated magnetic field compressor 101. In the embodiment represented, the magnetic field compressor 101 has a stator coil 102 and an armature casing 103. In the embodiment represented, the armature casing 103 is surrounded by the stator coil 102 and is kept at a radial distance from it. According to an embodiment that is not represented, one or more stator coils may also only partially surround the armature casing. An explosive charge 104 is embedded in the armature casing 103. The magnetic field compressor 101, or the stator coil 102, is electrically connected to a power source 105. For the detonation of the explosive charge 104, a trigger system 106 is provided, the trigger system 106 being controllable by a pulse of current from the power source 105, depending on a signal supplied by the missile (not represented). A great amount of electrical energy is generated in the stator coil 102 by the detonation of the explosive charge 104. To be more precise, the detonation of the explosive charge 104 causes a rapid change in the magnetic field built up in the stator coil 102 by the power source 105. In the embodiment represented, the active system 100 has a directional antenna 107 for the directional radiation of electrical energy generated by the detonation of the explosive charge 104.

Figure 2:
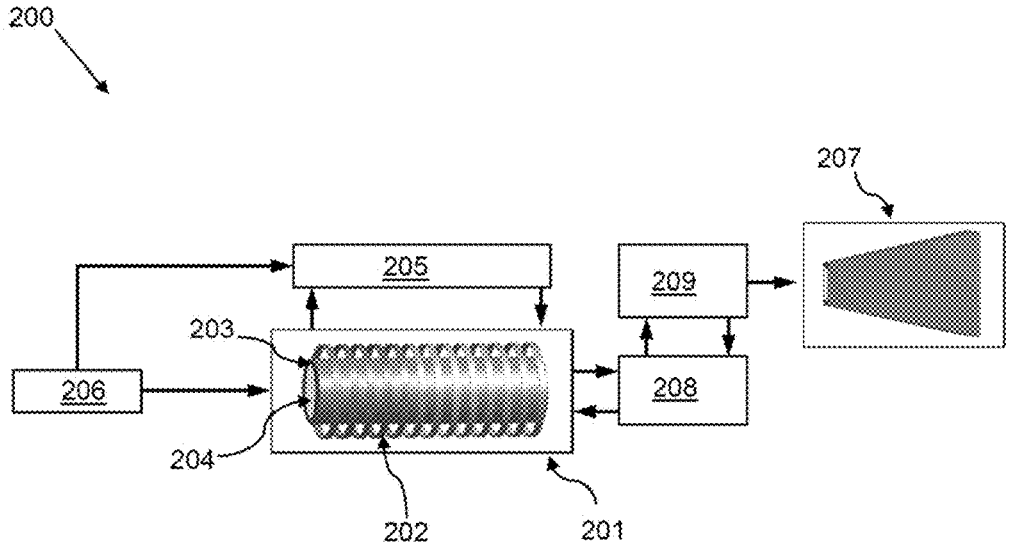
FIG. 2 shows a further more detailed embodiment of the electromagnetic active system.

In FIG. 2, a further more detailed embodiment of an electromagnetic active system 200 is represented. The active system 200 has a detonation-operated magnetic field compressor 201. The magnetic field compressor 201 has an armature casing 203, which is filled with an explosive charge 204 and is surrounded by a stator coil 202. The magnetic field compressor 201 is coupled to a power source 205, for example a capacitor bank, by which a magnetic field can be induced in the stator coil 202. The magnetic field compressor 201 is also connected to a trigger system 206. In response to a predetermined signal, the explosive charge 204 is initiated by way of the trigger system 206. The trigger system 206 may for example have a delay function. The initiation of the magnetic field in the stator coil 202 may for example likewise be controlled by way of the trigger system 206. The detonation of the explosive charge 204 brings about a change in the magnetic field built up in the stator coil 202, which suddenly generates a great amount of electrical energy. This energy is passed by way of a switching device 208, for example through corresponding power electronics, to a transmitter 209, for which purpose the stator coil 202 is electrically connected to the switching device 208 and the transmitter 209 is electrically coupled to the switching device. The transmitter 209 generates an electromagnetic radiation, which is radiated by the directional antenna 207 to a target.

Figure 3:
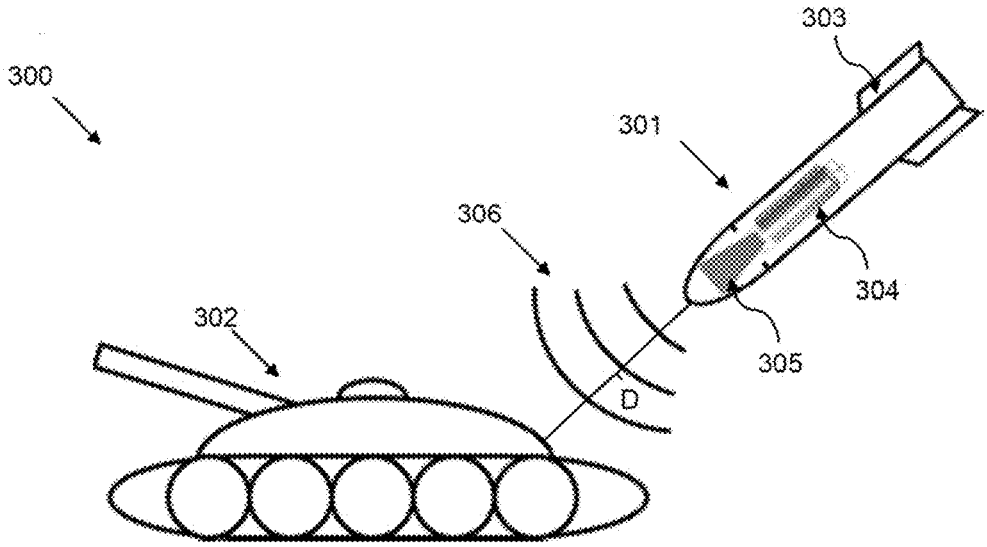
FIG. 3 schematically shows the effect of an embodiment of the electromagnetic active system on a target.

In FIG. 3, the effect 300 of an embodiment of the electromagnetic active system 301 on a target 302 is schematically shown. In the embodiment represented, the active system 301 is fitted in a missile 303. The active system 301 has a detonation-operated magnetic field compressor 304, which on detonation of an explosive charge emits an electromagnetic radiation 306 to the target 302 to be engaged by way of a directional antenna 305 in the missile 303. The detonation of the explosive charge takes place at a predetermined distance D of the missile 303 from the target 302.

In the case of an embodiment of the active system that is not represented, at least two or more active systems as previously described may be provided, it being possible for the effects of the active systems to be instigated simultaneously for a cumulative effect or to be triggered shortly one after the other for a multiple effect. Individual components, such as for example the power source, the switching device, the trigger system and the directional antenna, may also be provided here jointly for a number of active systems. For example, two or more active systems may have a common power source, by way of which the magnetic field is induced in the stator coil. For example, the trigger system may be designed to trigger multiple explosive charges simultaneously or shortly one after the other. If for example there are a plurality of explosive charges, it is possible here for some explosive charges to be triggered at the same time and other explosive charges to be triggered subsequently one after the other.

In the case of an embodiment of the active system that is not represented, there may be provided for example a deployment device which is designed to deliver the electromagnetic pulse generated by the detonation into the target D directly or over distances of up to 5 meters by conducting contact or spark discharge.

A detonation-operated magnetic field compressor 304 with about 8 kg of high-energy explosive is suitable for example for applications with about 12 to 18 kg of active system mass for combating specific sensors. A detonation-operated magnetic field compressor 304 with about 50 kg of high-energy explosive in a cascade circuit is suitable for example for applications with up to about 120 kg of active system mass.

The aim is for example to combat sophisticated targets with complex sensor systems, the electronics of which are destroyed, or at least jammed for a time, by the electromagnetic radiation 306 that is generated on detonation of the explosive charge. The effects of the active systems can be instigated here simultaneously for a cumulative effect or can be triggered shortly one after the other for a multiple effect.

Figure 4:
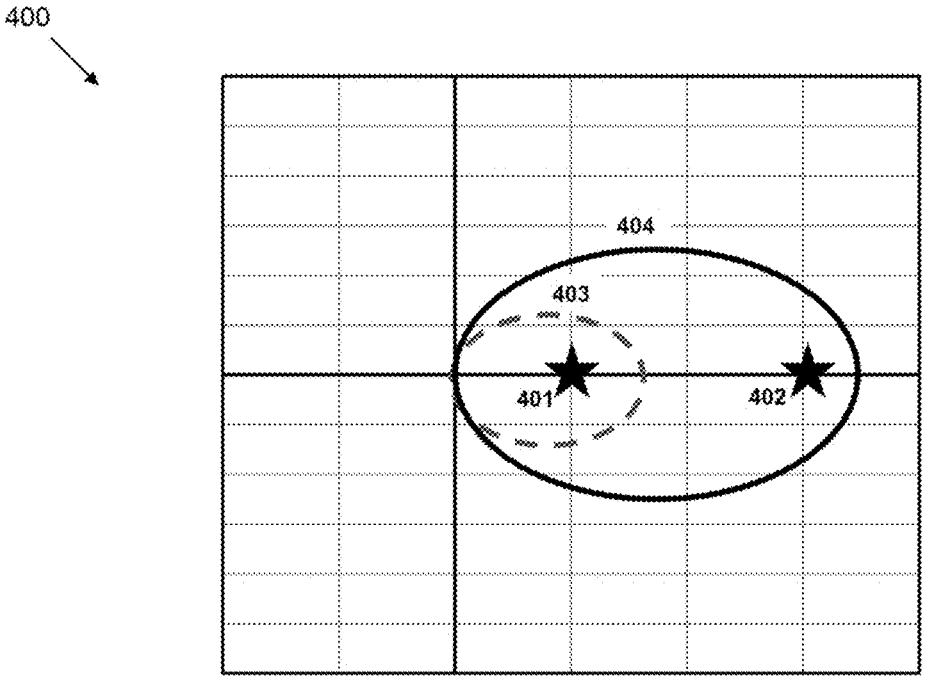
FIG. 4 schematically shows a plot of the effect in the area affected by an electromagnetic active system.

In FIG. 4, a plot of the effect 400 in the area affected by an electromagnetic active system is schematically represented. Here, the distance of the active system from the target to be engaged is represented on the x-axis. The extent of the area affected is schematically represented on the y-axis. In the case of a target 1 401, the initiation of the detonation of the explosive charge takes place at a small distance from the target. In the case of the target 2 402, the initiation of the detonation of the explosive charge takes place at a comparatively great distance.

In the case of target 1 401 and target 2 402, different destruction limits have been assumed here (for example the larger ellipse of the area affected 2 404 with a probability of destruction or damage of 50% and the smaller ellipse of the area affected 1 403 with a probability of destruction or damage of 100%). Apart from for example physical destruction of the electronic components, electrical failure due to short circuits or purely jamming by interference as a result of the interfering radiation may be used as criteria for the effect.

Figure 5:
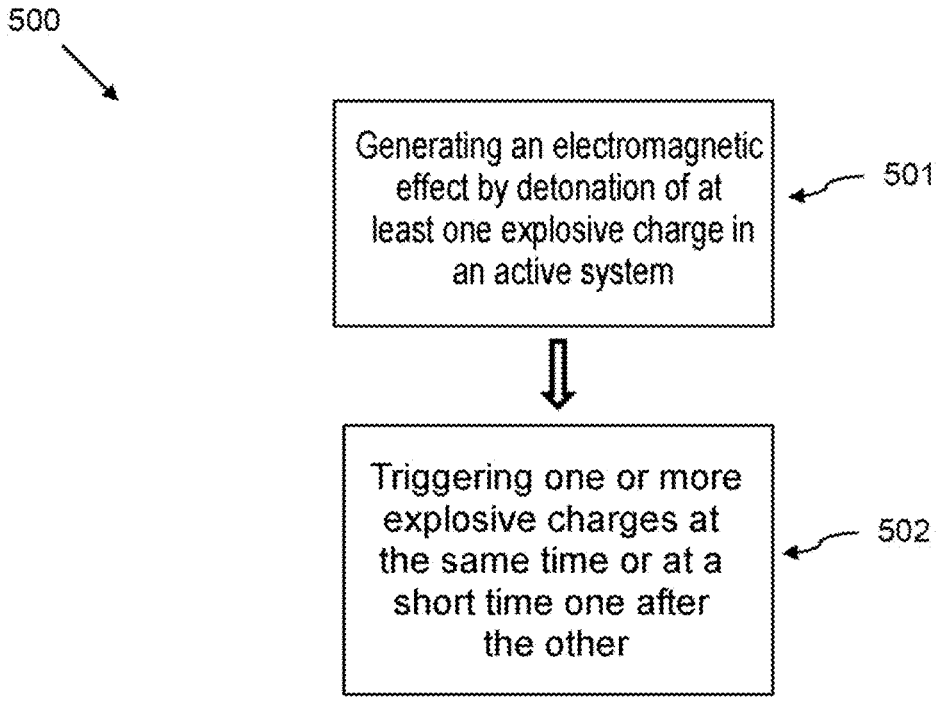
FIG. 5 schematically shows a flow diagram of a method for making a generated electromagnetic effect scalable at the target.

In FIG. 5, a flow diagram 500 of a method for making a generated electromagnetic effect scalable at the target is schematically shown.

A method for making a generated electromagnetic effect scalable at the target comprises generating an electromagnetic effect by detonation of at least one explosive charge in an active system as described above 501. The method also comprises triggering one or more explosive charges at the same time or at a short time one after the other 502. The detonation is triggered in dependence on a predetermined distance of the active system from the target. The amount of the at least one explosive charge used is preselected in dependence on the target to be hit.

Although the disclosure herein has been shown and described primarily with reference to specific embodiments, it should be understood by those familiar with the technical field that numerous modifications can be made thereto with regard to configuration and details without departing from the essence and scope of the disclosure herein as defined by the appended claims. The scope of the disclosure herein is thus determined by the appended claims, and the intention is therefore to encompass all modifications which come under the literal sense or the range of equivalence of the claims.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE SIGNS

100, 200, 301 active system
101, 201, 304 magnetic field compressor
102, 202 stator coil
103, 203 armature casing
104, 204 explosive charge
105, 205 power source
106, 206 trigger system
107, 207, 305 directional antenna
208 switching device
209 transmitter
300 arrangement
302 target
303 missile
306 electromagnetic radiation
400 plot of effect
401 target 1
402 target 2
403 area affected 1
404 area affected 2
500 flow diagram
501, 502 method steps
D distance

The invention claimed is:

1. An electromagnetic mobile active system for fitting in a missile, the system comprising:
a detonation-operated magnetic field compressor comprising:
at least one stator coil;
at least one armature casing, which is at least partially surrounded by the stator coil and is spaced a radial distance from it; and
at least one explosive charge, which is embedded in the armature casing;
at least one power source;
a trigger system for detonation of the explosive charge, the trigger system being controllable by a pulse of current from the power source, depending on a distance signal corresponding to a distance between the missile and a target; and
at least one directional antenna for directional radiation of electrical energy generated within the stator coil due to a rapid change of a magnetic field build up in the stator coil caused by the detonation of the explosive charge,
wherein the stator coil has a high ductility to maintain mechanical integrity of the stator coil for as long as possible during the detonation of the explosive charge and subsequent expansion.

2. The active system according to claim 1, wherein:
the stator coil comprises at least one winding;
the stator coil comprises copper, gold, aluminum, or another material that has a high electrical conductivity and mechanical properties to preserve current conduction between the stator coil and the armature casing for as long as possible during the detonation; and/or
the armature casing comprises depressions, notches, or other structure for controlled disintegration of the armature casing.

3. The active system according to claim 1, wherein the stator coil comprises a single-layer or multi-layer winding and a spacing of the windings of the stator coil increases at least partially in a direction of a front of the active system.

4. The active system according to claim 1, wherein the power source comprises a Marx generator, capacitor banks, a dielectric generator, and/or a ferroelectric generator.

5. The active system according to claim 1, wherein the explosive charge comprises a detonator and has an explosive mixture on a basis of HMX, TKX-50, CL-20, RDX, FOX-7, TATB, PETN, and/or TNT with a high detonation velocity.

6. The active system according to claim 1, comprising at least one switching device designed to transmit electrical energy generated by the detonation in the stator coil to the directional antenna.

7. The active system according to claim 1, wherein the distance signal can be activated based on a predetermined distance of the active system from the target.

8. The active system according to claim 7, wherein the predetermined distance between the active system and the target is between 5 and 100 meters.

9. The active system according to claim 1, comprising at least one deployment device designed to deliver an electromagnetic pulse generated by the detonation of the explosive charge into a target directly or over distances of up to 5 meters by conducting contact or spark discharge.

10. The active system according to claim 1:
wherein the explosive charge is arranged in a form of a hollow charge and/or configured to generate a blasting effect and/or a fragmenting effect; and/or
the active system comprising an electrically insulated casing comprising a magnetized and/or magnetizable material.

11. An active system arrangement having at least two active systems according to claim 1, wherein effects of the at least two active systems can be instigated simultaneously for a cumulative effect or can be triggered shortly one after another for a multiple effect.

12. A missile having at least one active system according to claim 1.

13. A method for generating a scalable electromagnetic effect at a target, the method comprising:
providing an electromagnetic mobile active system for fitting in a missile, the electromagnetic mobile active system comprising:
a detonation-operated magnetic field compressor comprising:
at least one stator coil;
at least one armature casing, which is at least partially surrounded by the stator coil and is spaced a radial distance from it; and
at least one explosive charge, which is embedded in the armature casing;
at least one power source;
a trigger system for detonation of the explosive charge, the trigger system being controllable by a pulse of current from the power source, depending on a distance signal corresponding to a distance between the missile and the target; and
at least one directional antenna for directional radiation of electrical energy generated within the stator coil due to a rapid change of a magnetic field build up in the stator coil caused by the detonation of the explosive charge, wherein the stator coil has a high ductility to maintain mechanical integrity of the stator coil for as long as possible during the detonation of the explosive charge; and triggering the trigger system using the power source;

detonating the at least one explosive charge based on a predetermined distance of the active system from the target; and generating an electromagnetic effect from detonating the at least one explosive charge;

wherein an amount of the at least one explosive charge detonated is preselected based on the target to be hit.

14. The method according to claim 13, comprising subsequently firing a volley of shots by at least one anti-tank missile and/or multi-role missile.

15. An electromagnetic mobile active system for fitting in a missile, the system comprising:

a detonation-operated magnetic field compressor comprising:

at least one stator coil;

at least one armature casing, which is at least partially surrounded by the stator coil and is spaced a radial distance from it; and at least one explosive charge, which is embedded in the armature casing, wherein the explosive charge is arranged in a form of a hollow charge and/or configured to generate a blasting effect and/or a fragmenting effect;

at least one power source;

a trigger system for detonation of the explosive charge, the trigger system being controllable by a pulse of current from the power source, depending on a distance signal corresponding to a distance between the missile and a target;

at least one directional antenna for directional radiation of electrical energy generated by the detonation of the explosive charge; and an electrically insulated casing comprising a magnetized and/or magnetizable material.

16. The active system according to claim 15, wherein the stator coil has a high ductility to maintain mechanical integrity of the stator coil for as long as possible during the detonation of the explosive charge and subsequent expansion.

17. The active system according to claim 15, wherein the distance signal is activated based on a predetermined distance of the active system from a target.

18. The active system according to claim 15, wherein:

the stator coil comprises at least one winding;

the stator coil comprises copper, gold, aluminum or another material that has a high electrical conductivity and mechanical properties to preserve current conduction between the stator coil and the armature casing for as long as possible during the detonation; and/or the armature casing comprises depressions, notches, or other structure for controlled disintegration of the armature casing.

19. The active system according to claim 15, wherein the stator coil comprises a single-layer or multi-layer winding and a spacing of the windings of the stator coil increases at least partially in a direction of a front of the active system.

20. The active system according to claim 15, comprising at least one switching device designed to transmit electrical energy generated by the detonation in the stator coil to the directional antenna.

* * * * *